United States Patent [19]

Gallo, Jr.

[11] 3,961,222

[45] June 1, 1976

[54] SODIUM VAPOR LAMP CONFIGURATION

[75] Inventor: Charles F. Gallo, Jr., Penfield, N.Y.

[73] Assignee: Xerox Corporation, Stamford, Conn.

[22] Filed: Dec. 16, 1974

[21] Appl. No.: 533,050

[52] U.S. Cl. ..... 315/49; 315/46

[51] Int. Cl.[2] ..... H01J 17/34

[58] Field of Search ..... 315/49, 46

[56] References Cited

UNITED STATES PATENTS

| | | | |
|---|---|---|---|
| 3,283,202 | 11/1966 | Pennington | 315/46 |
| 3,806,748 | 4/1974 | Cohen et al. | 313/15 |
| 3,878,416 | 4/1975 | Roche et al. | 315/49 X |

*Primary Examiner*—R. V. Rolinec
*Assistant Examiner*—Darwin R. Hostetter
*Attorney, Agent, or Firm*—Robert J. Bird

[57] ABSTRACT

In a sodium vapor lamp, a means for rapid warm-up and/or maintaining the temperature of the discharge tube in order to quickly achieve and maintain the sodium vapor pressure at a desired level is disclosed. The discharge tube is surrounded with a resistive conductor so as to ohmically heat the tube to a desired temperature, e.g. 270°C. The heating element is a resistive tube coating.

2 Claims, 3 Drawing Figures

SODIUM VAPOR LAMP CONFIGURATION

BACKGROUND OF THE INVENTION

This invention relates to gas or vapor discharge lamps as for example, sodium vapor lamps, and specifically to a means for raising vapor pressure within the lamp to improve its performance.

In the prior art, sodium vapor lamps are typically constructed with an inner discharge tube containing the active material sodium, the discharge tube being surrounded by an outer envelope with a vacuum between the inner tube and the outer envelope. The outer envelope is coated with an infrared reflector. Thus, heat loss from the discharge tube is held at a minimum for the purpose of raising the temperature of the discharge tube and maintaining it at a suitable operating level of about 260°–270°C.

Prior to startup, in its cold condition, the sodium vapor pressure within the lamp is very low. As the electrical energy is applied, the tube warms up and the sodium vapor pressure increases. This startup process is not instantaneous but takes an appreciable time. Two considerations are important. First, the sodium must be vaporized by an initial arc established in an argon or neon atsmosphere. Second, in order to emit light of a constant and maximum intensity the discharge through the now-vaporized sodium must stablize. The preferred temperature of the discharge tube corresponding to such stablization is about 260°–270°C, considered to be the optimum operating temperature range of a sodium vapor discharge lamp.

The prior art vacuum space between discharge tube and outer envelope, and the infrared reflector on the outer envelope have been effective to maintain the lamp operating temperature after stablization. But they have not been very effective to shorten the time lag between startup and stablization. This time lag is of no consequence in applications such as street lighting. But, the length of time in warmup can be a problem as for example, when such a light source is used in a photocopying system. An extended wait after switching on a photocopier and before it is usable is unacceptable.

SUMMARY OF THE INVENTION

It is an object of the present invention to provide a vapor discharge lamp including means to vaporize the active material and maintain it in a vaporized condition prior to lamp startup.

Another object is to provide a vapor discharge lamp including means to stablize the temperature of the system prior to lamp startup.

Briefly, this invention is practiced in one form by a low pressure sodium discharge lamp which includes a discharge tube surrounded by a vacuum space or an appropriate gas in an outer envelope. The discharge tube includes a resistive heating element associated therewith to raise its temperature to a suitable operating level prior to lamp startup in order to vaporize the active material (sodium) within the tube. In addition, this system is used to stablize the temperature of the lamp discharge tube after startup and during lamp operation to enhance lamp efficiency.

For a better understanding of this invention, reference is made to the following detailed description given in connection with the accompanying drawings.

DRAWINGS

DESCRIPTION

Figure 1:
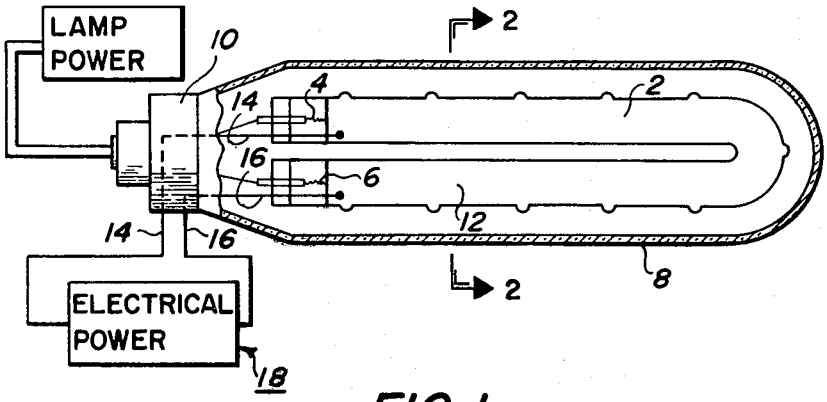
FIG. 1 is a diagram, partially schematic, of a vapor discharge lamp according to the present invention in its preferred embodiment.

Referring now to FIG. 1, a U-shaped discharge tube is indicated at 2 and is connected at each of its ends to electrodes 4 and 6. An outer envelope 8 surrounds the inner discharge tube 2 and the space between outer envelope 8 and inner discharge 2 may be evacuated or filled with an appropriate gas. The discharge tube 2 with its electrodes 4 and 6 and the outer envelope 8 are suitably mounted on a support or base member 10.

Figure 2:
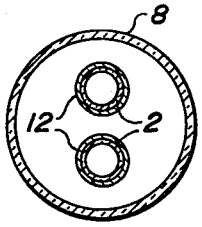
FIG. 2 is a sectional view taken along the line II—II of FIG. 1.

Discharge tube 2 is surrounded by a resistance coating of a conductive material, better shown as coating 12 in FIG. 2. Coating 12 is electrically connected by means of lead wires 14 and 16 to a suitable external source of electrical power 18.

The resistive coating 12 on the discharge tube 2 is preferably of a material which is both electrically conductive and transparent to visible radiation. One such material is tin oxide, $SnO_2$, for example.

Figure 3:
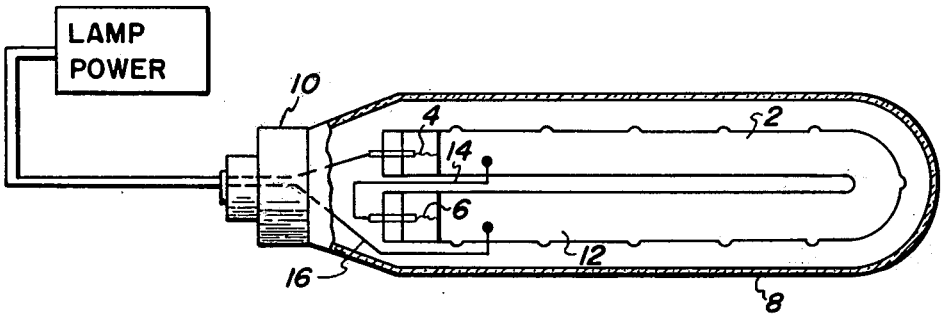
FIG. 3 is a diagram of a vapor discharge lamp showing an alternative embodiment of this invention.

Referring now to FIG. 3, another embodiment of this invention is shown in which the circuit of the heating element 12 is in series with the circuit of the lamp electrodes 4 and 6. Like most gas discharges, the sodium vapor discharge lamp has a negative differential resistance which ordinarily requires a current-limiting ballast to prevent the current from running away. The ballast limits the current by presenting an inductive-capacitive impedance to the line voltage. Such ballasts are usually heavy, bulky, and expensive. However, by running the electrical power of the lamp in series through the heating element as shown in FIG. 3, the resistance of element 12 provides a positive differential resistance and thus a natural current-limiting combination. In this arrangement, as is shown, the lampheating element series circuit is directly connected to the same power source.

In either the FIG. 1 or FIG. 3 embodiment, it is possible to heat the coating 12 to incandescence to give additional light.

The foregoing description of several embodiments of this invention is given by way of illustration and not of limitation. The concept and scope of the invention are limited only by the following claims and equivalents thereof which may occur to others skilled in the art.

What is claimed is:

1. A sodium vapor lamp comprising a sodium vapor discharge tube disposed within an outer transparent envelope, said discharge tube being substantially surrounded by a transparent coating of electrically conductive material being sufficiently resistive to the flow of electrical current to effect ohmic heating of said discharge tube when current is applied to said coating, a first and a second lamp electrode electrically connected to said discharge tube, a third and a fourth electrode electrically connected to said conductive coating, said first, second, third, and fourth electrodes being electrically in series with said first and fourth electrodes being connected to a source of electrical power, said conductive coating providing positive resistance in the circuit and heat to said discharge tube when energized.

2. A vapor discharge lamp comprising a vapor discharge tube having a first lamp electrode at one end and a second lamp electrode at the other end, said discharge tube being substantially surrounded by a transparent coating of electrically conductive material, a third electrode electrically connected to said conductive coating at one end of said discharge tube and a fourth electrode electrically connected to said conductive coating at the other end of said discharge tube, said first, second, third, and fourth electrodes being electrically in series with said first and fourth electrodes being connected to a source of electrical power, said conductive coating providing positive resistance in the circuit and being sufficiently electrically resistive to effect ohmic heating of said discharge tube when electrical energy from said source is applied.

* * * * *